US006676998B2

(12) United States Patent
Huang et al.

(10) Patent No.: US 6,676,998 B2
(45) Date of Patent: Jan. 13, 2004

(54) APPARATUS FOR CONTINUOUS COATING OF WIRE

(75) Inventors: Yen-How Huang, Solon, OH (US); Patrick Michael Orr, Akron, OH (US)

(73) Assignee: The Goodyear Tire & Rubber Company, Akron, OH (US)

( * ) Notice: Subject to any disclaimer, the term of this patent is extended or adjusted under 35 U.S.C. 154(b) by 0 days.

(21) Appl. No.: 10/158,614

(22) Filed: May 30, 2002

(65) Prior Publication Data

US 2003/0224118 A1 Dec. 4, 2003

(51) Int. Cl.[7] ..... B05D 1/18

(52) U.S. Cl. ..... 427/434.6; 427/424; 118/125; 118/DIG. 18; 118/DIG. 19; 118/325; 118/420

(58) Field of Search ..... 427/356, 358, 427/424, 357, 434.4–434.7, 435, 177, 178, 117, 118, 475, 482, 485; 118/125, 405, 304, 420, 423, 325, 407, 410, 421, DIG. 18, DIG. 19, DIG. 22, 308; 57/286, 296, 292; 425/113; 101/172; 68/205; 184/15.3; 28/169; 65/529

(56) References Cited

U.S. PATENT DOCUMENTS

| | | | | |
|---|---|---|---|---|
| 2,730,069 | A | 1/1956 | Sauer | 118/234 |
| 3,023,729 | A | 3/1962 | Hayden et al. | 118/234 |
| 3,266,461 | A | 8/1966 | Argue | 118/234 |
| 3,382,845 | A | 5/1968 | Jester | 118/610 |
| 3,877,414 | A | 4/1975 | Brideau et al. | 118/234 |
| 3,923,003 | A | 12/1975 | Carden | 118/405 |
| 3,930,464 | A | 1/1976 | Wallstein | 118/122 |
| 4,169,174 | A | 9/1979 | Bixby | 427/353 |
| 4,169,426 | A | 10/1979 | Kornmann | 118/67 |
| 4,174,678 | A | 11/1979 | Van Den Bergh | 118/307 |
| 4,316,358 | A | 2/1982 | Takai | 57/286 |
| 4,356,212 | A | 10/1982 | Stafford | 427/175 |
| 4,391,218 | A | 7/1983 | Horikawa et al. | 118/621 |
| 4,406,114 | A | 9/1983 | Lanier et al. | 57/7 |
| 4,455,159 | A | 6/1984 | Lamb et al. | 65/3.11 |
| 4,573,314 | A | 3/1986 | Lorenz | 57/296 |
| 4,595,600 | A | 6/1986 | Keeven et al. | 427/5 |
| 5,362,326 | A | 11/1994 | Hasui et al. | 118/44 |
| 5,588,997 | A | 12/1996 | Lysson et al. | 118/405 |
| 5,983,618 | A | 11/1999 | Bruynell | 57/3 |
| 6,322,630 | B1 | 11/2001 | Carroll et al. | 118/681 |
| 6,461,684 | B1 * | 10/2002 | Huang et al. | |

FOREIGN PATENT DOCUMENTS

| | | | |
|---|---|---|---|
| GB | 771830 | 4/1957 | |
| GB | 2153708 | 8/1985 | B05C/3/12 |

* cited by examiner

*Primary Examiner*—Brenda A. Lamb
(74) *Attorney, Agent, or Firm*—Nancy T. Krawezyk

(57) ABSTRACT

The invention provides an apparatus and method which can be utilized to apply a thin layer of viscous coating material to an elongated continuously moving filament whereby the filament can be cabled, coated, and spooled in a continuous operation. The apparatus has a coating material applicator to deliver a flowable material, an air applicator to supply compressed air, a mixer to mix the flowable material and compressed air, a delivery means to spray the mixed flowable material and air onto a filament, and a coating chamber through which the filament passes. The chamber has a material collector and a coating die, and a sealing attachment with an exit hole is located beneath the coating chamber. The filament is sprayed before it travels into the material collector.

18 Claims, 2 Drawing Sheets

APPARATUS FOR CONTINUOUS COATING OF WIRE

FIELD OF THE INVENTION

The present invention relates generally to a continuous coating apparatus and method. More particularly, the invention is directed to a cord coating apparatus and a method for the continuous coating of thin layer of viscous materials on a moving cord or filament.

BACKGROUND OF THE INVENTION

Coatings of 1–2 μm and less are needed for the treatment of the tire cord and wires to improve tire durability, wire-rubber interfacial bonding, and corrosion aging resistance. It is known to use a continuous method to produce coated wires using apparatus consisting of a coating die which surrounds a wire and an extruder that extrudes coating material into the die around the wire. In industry, such an apparatus has been used in the coating of insulating material around electrical conducting wire where the needed coating thickness was 1 mil and thicker. However, the needed coating of 1–2 μm and less for the tire cord surface treatment is impossible to apply by conventional extrusion die coating process.

In another known continuous method to control the coating thickness of tire cord down to 1–2 μm or less, an air-wipe is used that wipes off excess coating materials right after a conventional dip-coat procedure. However this method is mainly employed to control the thickness of water base latex coat of a low viscosity coating material. For a high viscosity coating material such as an oil base mixture having a viscosity of 100 SUS and higher, the conventional dip-coat with air-wipe method is very difficult to operate and control. Additionally, the air-wipe which uses a strong air blast to wipe off the excess coating may limit the penetration of the coating material into the inner cord because of the volume expansion of the trapped air inside the cord according to the Bernoulli principle of physical matter.

SUMMARY OF THE INVENTION

The advantages of the present invention are numerous and are as follows.

The invention provides an apparatus and method which can be utilized to apply a thin layer of viscous coating material to an elongated continuously moving filament whereby the filament can be cabled, coated, and spooled in a continuous operation.

The invention provides an apparatus and method for applying a thin layer of latex base coating material to a continuously moving cord for an improved coating penetration.

The invention provides an apparatus and method for applying a thin layer of coating material with a high coating efficiency.

The invention provides an apparatus and method that can be utilized to improve cord coating at processing speeds that are limited only by the pay-off and the wire take-up services.

The invention provides an apparatus and method which optimized the coating mist typically associated with coating operations, thereby reducing the cost of the pollution control equipment and the recycling of excess coating materials.

The invention provides an apparatus and method that eliminates the need for highly complex machinery.

The present invention provides an improved wire manufactured by a technique having all the advantages of a conventional wire process but none of the disadvantages.

The disclosed apparatus has a coating material applicator to deliver a flowable material, an air applicator to supply compressed air, a mixer to mix the flowable material and compressed air, a delivery means to spray the mixed flowable material and air onto a filament, and a coating chamber through which the filament passes. The chamber has a material collector and a coating die, and a sealing attachment with an exit hole is located beneath the coating chamber. The filament is sprayed before it travels into the material collector.

In one aspect of the invention, the coating material applicator is selected from the group consisting of a constant volume material ejector, an intermeshing positive displacement multi-screw delivery pump, and a gear pump.

In one aspect of the invention, the delivery means is inclined at an angle relative to the coating chamber and the lowermost end of the delivery means is adjacent to the material collector.

In another aspect of the invention, the sealing attachment is shaped to form a spherical cone with the hole at the apex, forming an open area through which the filament passes.

In another aspect of the invention, the coating chamber dimensions can be varied. For example, the top entrance of the coating chamber may have a diameter larger than the main portion of the coating chamber and the exit of the coating chamber may have a diameter less than the coating die.

In another aspect of the invention, the coating chamber is mounted on a frame capable of linear movement relative to a take-up spool. This helps to ensure smooth and even spooling of the coated filament.

In another aspect of the invention, the material collector has an interior converging wall to permit collection of any stray flowable material.

In another aspect of the invention, the coating chamber has a vertical orientation. The vertical orientation of the chamber assist the flow pattern of the flowable material as it is sprayed onto the moving filament and in forming a small volume dip bath through which the filament may pass.

In another aspect of the invention, a cabling device is operatively associated with the coating apparatus.

Also disclosed is a method of coating a filament with a flowable material. The method includes the steps of providing a flowable material, providing compressed air, mixing the flowable material and the compressed air, spraying the mixing flowable material and compressed air onto a moving filament to coat the filament, and passing the filament through a material collection die, a coating die, and an exit hole having a diameter not more than the diameter of the filament.

In another aspect of the method, the filament passes through an open area prior to passing through the exit hole.

Also disclosed is a method of applying a coating of less than 2 μm on a moving filament. The method includes the steps of moving a filament along a defined travel path, providing a mix of a flowable material and a compressed air, spraying the flowable material and compressed air onto the moving filament, passing the filament through a small volume dip pool, and pulling the filament through a hole having a diameter not more than the diameter of the filament.

In one disclosed aspect of the method of applying a coating of less than 2 μm on a moving filament, the small volume dip pool has a volume of not more than 1.0 cc of liquid.

In another aspect of the method of applying a coating of less than 2 $\mu$m on a moving filament, there is the further step of passing the filament through an open area after passing the filament through the small volume dip pool and before pulling the filament through the hole.

In both methods disclosed, the filament may be formed of either steel or an organic material.

BRIEF DESCRIPTION OF THE DRAWINGS

The invention will be described byway of example and with reference to the accompanying drawings in which.

DETAILED DESCRIPTION OF THE INVENTION

The Apparatus

Figure 1:
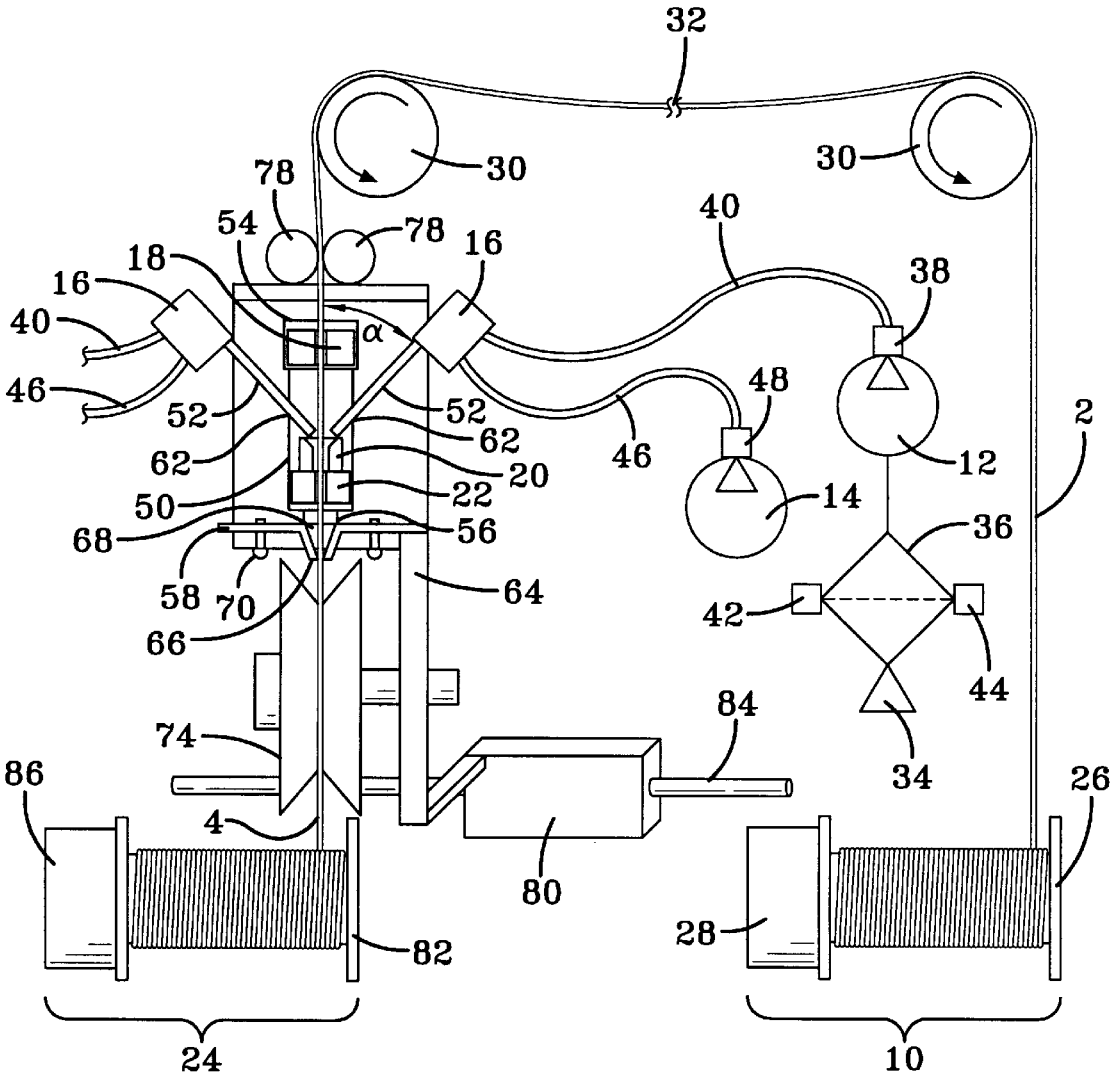
FIG. 1 is an illustration of the entire coating system with the coating chamber in cross sectional view.

Referring to the drawings, and specifically to FIG. 1, the apparatus of the invention will be described. The apparatus has a filament pay-off device 10, a coating material applicator, a low-pressure air applicator 14, an air-material mixer 16, a centering die 18, a material collector 20, a coating die 22, and a filament take-up device 24.

The term "filament" is used herein for all strand materials whether a single filament or a cord formed of many filaments. The filaments may be steel, organic, or any other strand material. While the embodiments herein described primarily relate to the manufacture of steel cord for reinforcing various articles, the apparatus of the invention has utility in coating all sorts of filaments other than the filament used in the production of the reinforcement materials.

The filament pay-off device 10 includes a spool 26 on which the filament to be coated is stored. The spool 26 is mounted on a spindle (not illustrated) to permit free rotation of the spool 26. Operatively associated with the spool 26 is a brake 28 that restrains the rotation of the spool 26 as the filament 2 is being pulled from the spool 26 so as to prevent entanglements. The filament 2 travels about pulleys 30 as it travels to the coating apparatus.

At any point 32 along the filament path, depending upon the end use of the coated filament or the initial state of the filament 2 on the pay-off device 10, conventional wire cabling apparatus, such as twisting, bunching, or stranding machines, may be employed. Thus, many filaments 2 of similar or different sizes may be cabled to the desired wire structure by conventional cabling equipment prior to the coating.

Alternatively, if the coating apparatus is located in an organic filament manufacturing plant, the pay-off device 10 may be eliminated and the filament may be formed immediately prior to the coating operation. In all instances, conventional forming, twisting, and cabling operations can be used in add to or in substitution of the pay-off device 10.

The term "flowable material" is used herein for the general class of coating materials applied by the method and apparatus of the invention. While the specific embodiments herein described refer to viscous oil that carry active ingredients to improve the tire durability, other flowable coating materials are contemplated as being within the general class of materials which can be applied by the method and apparatus of the invention. These materials include those which are initially flowable but later hardened by curing or thermosetting the material and also coating materials which may include up to about 90% by weight of solvent or water to render them flowable and later reversible by driving the solvent or water from the material. In the manufacture of tire steel cords, several different materials can be applied using the method and apparatus of the invention. These include rubber process oil with viscosity up to 2000 SUS, corrosion inhibitor such as calcium salts and the wire-bonding agent such as cobalt salts.

The flowable material is provided by the material applicator 12, which may be described as a positive displacement delivery system. The flowable material applicator 12 has a chute 34 by which the material is supplied to the applicator 12, a material reservoir 36 in which the material is stored, and a positive displacement pump 38 which delivers the flowable material to the air material mixer 16. An additional control device (not illustrated) may be associated with the positive displacement pump 38 to control the actual amount of flowable material delivered. An exact amount of flowable material is delivered through the tube 40 to the air material mixer 16.

If it is desired that the flowable material be mixed with solvent or water, both the coating material and the solvent may be fed into the applicator 12 via the chute 34. The reservoir 36 may also be provided with a mixing apparatus 42 having associated therewith a separate control. When using temperature sensitive flowable materials, the reservoir 36 may be provided with a temperature control means 44 by which the temperature of the material in the reservoir 34 can be controlled. The fluid material applicator 12 may be a constant volume material ejector, an intermeshing multi-screw pump, or a gear pump, all having some or all of the features described above.

Since the coating thickness is less than 2 $\mu$m, at a regular wire process speed the amount of flowable material needed from a material applicator is about 0.06 cc/second or less. Under this situation, a stable flow rate of viscous material is not obtainable from a conventional fluid material applicator, resulting in poor coating uniformity on the filament 2. To overcome this difficulty, compressed air is combined with the flowable material. The air applicator 14 supplies compressed air to the mixer 16 through the air tube 46. The needed air pressure is controlled by device 48.

Compressed air provides two major functions. First, the air that is introduced in to the mixer 16 crushes the flowable material into numerous tiny droplets so that the flowable material is uniformly dispersed through the material dispenser tube 52 toward the filament 2 without generating a hazardous mist. Secondly, the higher air pressure at the end of the delivery tube forces the flowable material onto the filament 2, and toward any interior strands of filament 2, thereby improving the coating penetration.

As already noted, flowable material via tube 40 and compressed air via air tube 46 are delivered to the air material mixer 16. The material is crushed by the compressed air and is delivered to the coating chamber 50 by means of the material dispenser tube 52.

Coating of the filament 2 occurs within the coating chamber 50. The coating chamber 50 has a top entrance bore 54 and a bottom exit hole 56. The coating chamber 50 houses the centering die 18, the material collector 20, and the coating die 22. A sealing attachment 58 is located beneath the coating chamber 50 and operates with the chamber components to execute the desired coating. The major function and specification of each component will be best understood by reference to the following description.

Figure 2:
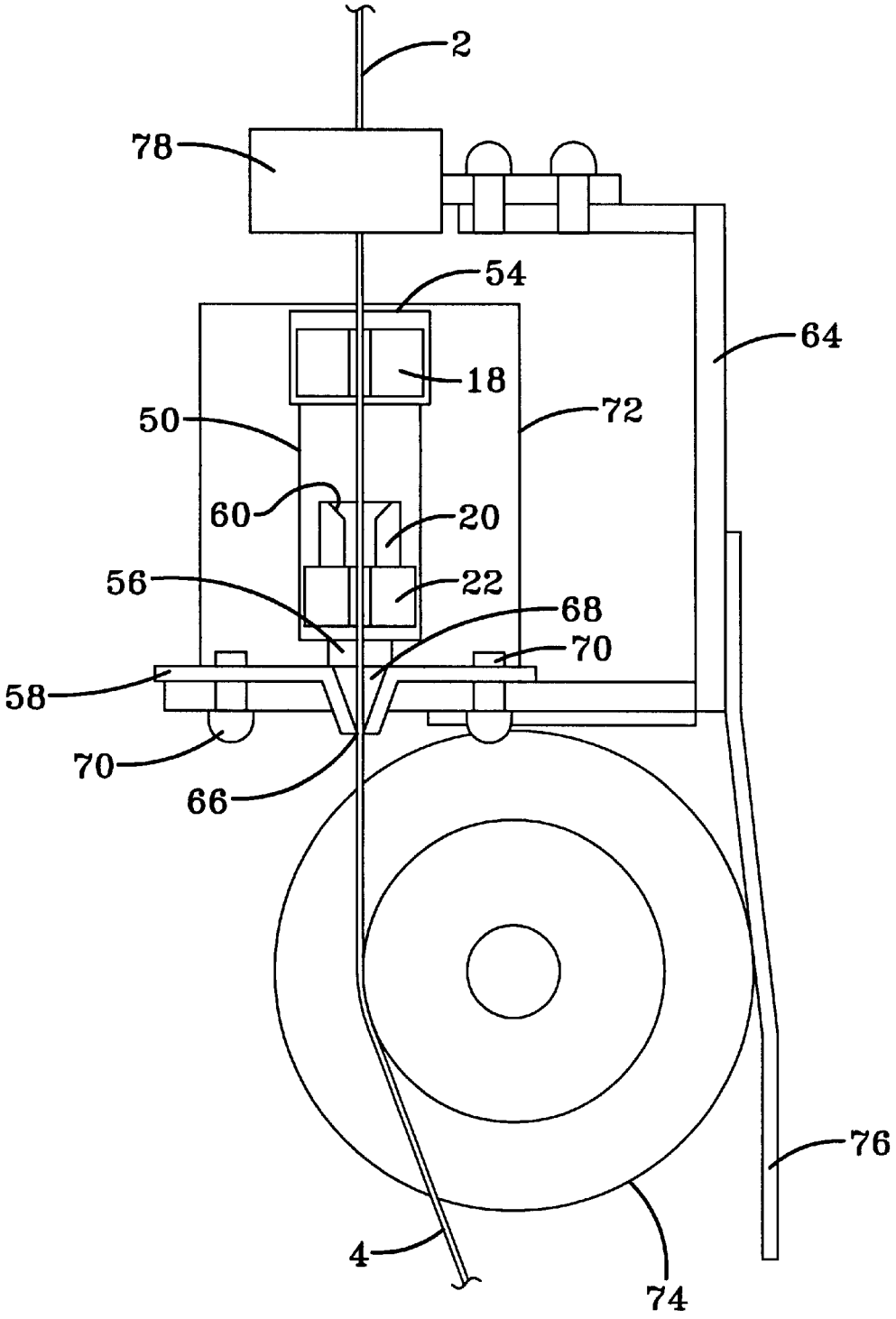
FIG. 2 is another cross sectional view of the coating chamber and other elements.

Referring to FIGS. 1 and 2, the coating chamber 50, commences with the entrance bore 54 and terminates with the exit hole 56 at the bottom. Centering die 18 is located below the entrance bore 54 and the coating die 22 is located above the exit hole 56.

The size of the entrance bore 54 is determined by the size of the centering die 18. To permit removal of the centering die 18 for replacement or general maintenance, the entrance bore 54 is slightly larger than the centering die 18. Additionally, as illustrated in FIG. 1, to hold the centering die in position within the chamber 50, the size of the centering die is larger than the size of the main portion of the chamber 50. However, in a different variation, the centering die 18 may be larger than the entrance bore 54, so that the centering die 18 stays in place at the top of the chamber 50 without any additional external support.

The size of the main portion of the chamber 50 is determined by the size requirements of the coating die 22. In the illustrated embodiment, the chamber 50 is slightly larger in size than that of the coating die 22 so that the coating die 22 can be easily slide in or out of the chamber 56 when die replacement or a general maintenance is needed.

The exit hole 56 has a diameter less than that of the coating die 22 so that the coating die 22 stays at the bottom of the chamber 50 without additional support.

Located above the coating die 22 is the funnel-shaped material collector 20. The material collector 20 has a converging interior wall 60 that interconnects with the underneath coating die 22. The interior wall 60 defines a cavity into which stray coating material can be collected. Preferably, the cavity will hold about 1.0 cc of material. The collected material then drips down to the coating die 22 to continue coating the filament 2. In a different embodiment, both the material collector 20 and the coating die 22 may be replaced with just a single coating die with a flared opening in order to collect any stray coating material.

Along the wall of the coating chamber 50 there is one or more inclined through-holes 62, allowing the material dispenser tube 52 to slide into the coating chamber 50. The tube 52 defines an angle a with filament 2. Angle $\alpha$ can be any value between 10° and 90°. In a specific embodiment, the angle $\alpha$ is about 45°. As seen in FIG. 1, the end of the material dispenser tube 52 is located close to the material collector 22 and the moving filament 2 so that the flowable material is directed onto the filament 2 and any stray material will collect in the material collector 22.

The coating chamber 50 is set inside a support frame 64. In order to prevent material from leaking from the bottom of the coating chamber 50, the sealing attachment 58 is inserted between the coating chamber 50 and the support frame 64. At the center of the sealing attachment 58, there is an exit hole 66 with a diameter equal or smaller than the overall diameter of the coated filament 4. The sealing attachment 58 is shaped to form a spherical cone with the hole 66 at the apex, thereby forming an open area 68. In one embodiment, the area 68 is defined about 120-degree angle bisected by the longitudinal centerline of the attachment 58. The spherical cone configuration, and the open area 68, can be preformed before inserting the sealing attachment 58 into position. The configuration can also be formed on a flat piece of sealing attachment 58 by a skillful practice of tightening the screws 70.

The sealing attachment 58 provides two functions. First, there is a chance that the coating material may accumulate at the exit hole 66 and then the accumulation will start to drip downwards. Due to the presence of the sealing attachment 58, the leaking drops are retained in the area 68 around the coated filament 4, so that a coating of 100% efficiency is obtained. Second, it is possible, but not desired, that some of the tiny flowable material droplets inside the mixer 16 may combine into big droplets on the wire surface, potentially degrading the coating uniformity. To improve the coating uniformity, the sealing attachment 58 smears or smoothes out those big droplets by rubbing the surface of moving coated filament 4. The sealing attachment 58 is preferably formed of resilience elastomeric material such as rubber with a preferred thickness of about 1–2 mm.

In FIG. 2, the support frame 64 is shown in side view to indicate the needed alignment of the centering die 18, and the coating die 22. Additionally, a housing 72 may be positioned with the support frame 64 to house the coating chamber 50 and maintain the chamber in a vertical orientation.

Below the base of the support frame 64 is a take-up pulley 74. As illustrated in FIG. 1, the pulley 74 preferably has a v-groove in which the coated filament 4 travels. Due to the interaction between the surface of the pulley 74 and the coated filament 4, the coating is further pushed into the filament 4 and any remaining excess spots of coating are smoothed out. To prevent a build up of coating and any possible contamination on the pulley 74, a shield 76 may be added to the side of the support frame 64 that will wipe off any excess coating. The shield 76 can be formed of any type of cleaning paper.

A set of guide rollers 78 are mounted on top of the support frame 64 to pre-align the filament 2 prior to the filament 2 entering the centering die 18.

The support frame 64 is also connected to a linear drive 80 for the take-up spool 82. Linear drive 80 travels back and forth along the axis 84 in association with the rotation of the take-up spool 82 during the take-up operation to evenly spool the coated filament 4 onto the take-up spool 82. The spool 82 may be a conventional spool on which coated filaments are conventionally stored or shipped. The spool 82 is mounted on a spindle (not illustrated) for rotation. Operatively connected to the spool 82 is a spool driver 86 that drives the spool 82 and pulls the filament 2 from the spool 26 of the pay-off device 10.

The Method

Filament 2 is unwound from the pay-off spool 26, passing over any necessary pulleys 30 to prevent the filament 2 from becoming entangled. The illustrated filament 2 may be cabled or otherwise formed prior to passing over the last pulley 30 and passing between the guide rollers 78. The filament 2 is guided into the coating apparatus by the guide rollers 78 and passes through the centering die 18.

A flowable material containing an oil-based, water-based, or organic based coating material to be applied to the filament 2 is stored in the reservoir 36 at a flowable temperature. The flowable material passes through tube 40 and into the air material mixer 16. Compressed air is also delivered to the mixer 16 via air tube 46 at a desired pressure; the pressure being selected by controls 48.

The specific air pressure is closely controlled. The air pressure must be high enough to mix the flowable material in the mixer and force the flowable material down to any central core or strands of the filament 2, but still low enough to prevent the formation of a mist. To avoid forming a mist, the air pressure must be controlled in accordance to the viscosity of the flowable material. For an oil-based material of 500 SUS viscosity, the air pressure is preferable controlled at 2–3 psi.

The mixed flowable material and compressed air is delivered by the dispenser tube 52 and is deposited onto the surface of the filament 2 just before the filament enters the material collector 20 and the coating die 22. Coating material that misses the filament 2 is collected by material collector 20, and then either drips down to the coating die 22 or accumulates inside the cavity of the collector 20. Normally the stray material that is collected by the material collector 20 quickly drips down to the coating die 22 with the help of the moving filament 2.

The specific amount of the coating material to be applied to the filament 2 is accurately metered. If there is an excess of flowable material, the material may drip from the hole 66. Also, too great an excess of flowable material of the coated filament 4 may also result in the dripping of the flowable material from the take up spool 82 causing problems in handling the spools 82. For these reasons, the material applicator 12 is provided with controls.

However, if the coating layer is thicker than desired, the control is thereafter adjusted to reduce the amount of material being delivered. Conversely, if the coating layer proves to be insufficient, the control is adjusted so as to accumulate a tiny pool of flowable material inside collector 20 for an extra short-term dip coating before the filament 2 passes through the coating die 22.

Additionally, if it is believed that at the initial coating act, the actual coating thickness may be slightly less than what is expected and desired, the operator can pre-spray flowable material into material collector 20 for 10–20 seconds before the coating start to generate a short-term dip pool.

After passing through the coating die 22, the coated filament 4 passes through the chamber exit hole 56 and into the open area 68 and then through the exit hole 66 in the sealing attachment 58. The provision of the sealing attachment 58 with the open area 68 provides the filaments 4 with a surprisingly uniform coating thickness along the wire. Conversely, when the open area 68 is not present, coating thickness of lower uniformity is found.

After passing through the attachment exit hole 66, the coated filament 4 travels over the take up pulley 74 and is wound onto the take-up spool 82. To maintain even winding of the coated filament 4 on the take-up spool 82, as needed, the coating apparatus, by means of the linear drive 80 travels along the axis 84.

The operation and function of the take-up device 24 was described earlier. However, the speed at which the take-up device 24 was driven was not mentioned. The speed is not limited in any way by the method of the invention. The pay-off device 10 and the take-up device 24 themselves solely limit the speed of coating when applying any of the coating materials mentioned herein. When the pay-off device 10 is eliminated and conventional cabling operations are substituted therefore, the speed at which the driver 84 drives the take-up device 24 is solely limited by the take-up device 24 itself.

The method of the invention has been successfully used with filaments in a wide range of sizes. The method and apparatus of the invention can also coat cords of rectangular cross-sections and of other cross-sections so long as the coating die 22 can be provided in geometrically similar shapes.

Coating materials of various types have been successfully applied to filaments of various sizes in accordance with the method of this invention by the apparatus above, the coating materials having a viscosity from about 100–2000 SUS.

The Tire Steel Cord

For the manufacture of cords used in reinforcing tires, metallic cords are treated to improve the ability of the cored to adhere to rubber and increase the corrosion resistance of the cord. A surprising characteristic of all steel cords coated in accordance with the apparatus and method of the present invention is the coating uniformity and the continuity. The continuity and uniformity of thin coatings applied from solution permits a reliance upon a single coat of the viscous material, something atypical in this industry.

The flowable material contains a soluble bonding agent and/or corrosion inhibitor. The deposit of the flowable material results in improved wire adhesion, improve cable fatigue resistance and wire corrosion resistance. The treated filaments are then contacted with vulcanizable rubber compositions to form metal reinforced rubber plies. These plies may be used to manufacturer tires and also other rubber articles such as conveyor belts, hoses, and the like.

The metallic cord to be coated according to the present invention may be steel, zinc-plated steel or brass-plated steel. Preferably, the metallic cord is brass plated steel.

The steel substrate may be derived from those known to those skilled in the art. For example, the steel used for wire may be conventional tire cord rod including AISI grades 1070, 1080, 1090 and 1095. The steel may additionally contain varying levels of carbon and microalloying elements such as Cr, B, Ni and Co.

The term "cord" means one or more of a reinforcing element, formed by one or more filaments or wires which may or may not be twisted or otherwise formed. Therefore, cords using the present invention may comprise from one (monofilament) to multiple filaments. The number of total filaments or wires in the cord may range from 1 to 134. Preferably, the number of filaments or wires per cord ranges from 1 to 49.

The number of cord constructions which can be treated according to the present invention are numerous. Representative examples of such cord constructions include 2×, 3×, 4×, 5×, 6×, 7×, 8×, 11×, 12×, 27×, 1+2, 1+3, 1+4, 1+5, 1+6, 1+7, 1+8, 1+14, 1+15, 1+16, 1+17, 1+18, 1+19, 1+20, 1+26, 2+1, 2+2, 2+5, 2+6, 2+7, 2+8, 2+9, 2+10, 2/2, 2/3, 2/4, 2/5, 2/6, 3+1, 3+2, 3+3, 3+4, 3×4, 3+6, 3×7, 3+9, 3/9, 3+9+15, 4+3, 4×4, 5/8/14, 7×2, 7×3, 7×4, 7×7, 7×12, 7×19, 5+1, 6+1, 7+1, 8+1, 11+1, 12+1, 2+7+1, 1+4+1, 1+5+1, 1+6+1, 1+7+1, 1+8+1, 1+14+1, 1+15+1, 1+16+1, 1+17+1, 1+18+1, 1+19+1, 1+20+1, 2+2+8, 2+6+1, 2+7+1, 2+8+1, 2+9+1, 2+10+1, 2+2+8+1, 3+9+15+1, 27+1, 1+26+1, 7×2+1, 3+9+1, 3/9+1, 7×12+1 and 7×19+1. The filaments in the cord constructions may be preformed, waved or crimped. The preferred cord constructions include 2×, 3×, 1+5, 1+6, 1+18, 2+7, 3+2, 3+3 and 3/9+1.

The diameter of an individual wire or filament that is encapsulated or used in a cord that is encapsulated may range from about 0.08 to 0.5 mm. Preferably, the diameter ranges from 0.15 to 0.42 mm.

The tensile strength of the steel filaments in the cord should be at least 3040 MPa –(1200×D) when D is the diameter of the filament. Preferably, the tensile strength of each filament ranges from about 3040—(1200×D) to 4400 MPa—(2000×D).

The flowable material is applied to the filament 2 in an amount equal to what is needed to form a coat of 1–2 $\mu$m or less in thickness.

While there have been described above the principles of this invention in connection with specific apparatus, it is to be clearly understood that this description is made only by way of example and not as a limitation to the scope of the invention.

What is claimed is:

1. An apparatus for coating a filament, the apparatus comprising:

a coating material applicator to deliver a flowable material, an air applicator to supply compressed air, a mixer to mix the flowable material and compressed air, a delivery means to spray the mixed flowable material and air onto a filament, and a coating chamber through which the filament passes, the chamber comprising a material collector and a coating die, and a sealing attachment beneath the coating chamber, the sealing attachment having an exit hole, wherein the filament is sprayed before it travels into the material collector.

2. An apparatus as set forth in claim 1 wherein the coating material applicator is selected from the group consisting of a constant volume material ejector, a intermeshing positive displacement multi-screw delivery pump, and a gear pump.

3. An apparatus as set forth in claim 1 wherein the delivery means is inclined at an angle relative to the coating chamber and the lowermost end of the delivery means is adjacent to the material collector.

4. An apparatus as set forth in claim 1 wherein the sealing attachment is shaped to form a spherical cone with the hole at the apex, forming an open area through which the filament passes.

5. An apparatus as set forth in claim 1 wherein a cabling device is operatively associated with the coating apparatus.

6. An apparatus as set forth in claim 1 wherein the top entrance of the coating chamber has a diameter larger than the main portion of the coating chamber.

7. An apparatus as set forth in claim 1 wherein the exit of the coating chamber has a diameter less than the coating die.

8. An apparatus as set forth in claim 1 wherein the coating chamber is mounted on a frame capable of linear movement relative to a take-up spool.

9. An apparatus as set forth in claim 1 wherein the material collector has an interior converging wall.

10. An apparatus as set forth in claim 1 wherein the coating chamber has a vertical orientation.

11. A method of coating a filament with a flowable material, the method comprising the steps of:

providing a flowable material, providing compressed air, mixing the flowable material and the compressed air, spraying the mixing flowable material and compressed air onto a moving filament to coat the filament, and passing the filament through a material collection die, a coating die, and an exit hole having a diameter not more than the diameter of the filament.

12. A method as set forth in claim 11 wherein the filament travels in a vertical direction as it passes through the material collection die, the coating die, and the exit hole.

13. A method as set forth in claim 11 further comprising the step of passing the filament through an open area prior to the exit hole.

14. A method of applying a coating of less than 2 $\mu$m on a moving filament, the method comprising the steps of:

moving a filament along a defined travel path, providing a mix of a flowable material and a compressed air, spraying the flowable material and compressed air onto the moving filament, passing the filament through a small volume dip pool, and pulling the filament through a hole having a diameter not more than the diameter of the filament.

15. A method as set forth in claim 14 wherein the small volume dip pool has a volume of not more than 1.0 cc of liquid.

16. A method as set forth in claim 14 further comprising the step of passing the filament through an open area after passing the filament through a small volume dip pool and before pulling the filament through the hole.

17. A method as set forth in claim 14 wherein the filament is a steel filament.

18. A method as set forth in claim 14 wherein the filament is an organic filament.

* * * * *